US005328432A

United States Patent [19]

Gvoich

[11] Patent Number: 5,328,432

[45] Date of Patent: Jul. 12, 1994

[54] RECIPROCATING VARIABLE ISOTONIC RESISTANCE UPPER EXTREMITY AND UPPER TORSO EXERCISER

[75] Inventor: Ned Gvoich, Beamsville, Canada

[73] Assignee: Kordun, Ltd., Studio City, Calif.

[21] Appl. No.: 138,796

[22] Filed: Oct. 18, 1993

[51] Int. Cl.[5] ..... A63B 21/018

[52] U.S. Cl. ..... 482/118; 482/114; 482/139

[58] Field of Search ..... 482/124, 74, 121, 122, 482/114, 115, 118, 119, 120, 139, 131, 82

[56] References Cited

U.S. PATENT DOCUMENTS

| | | | |
|---|---|---|---|
| 1,432,013 | 10/1922 | Blake | 482/124 |
| 1,618,273 | 2/1927 | Davidson | 482/124 |
| 4,540,173 | 9/1985 | Hopkins, Jr. | 482/114 |
| 4,961,573 | 10/1990 | Wehrell | 482/74 |
| 4,986,537 | 1/1991 | Dorta | 482/118 |
| 5,137,272 | 8/1992 | Wilkinson | 482/74 |
| 5,141,223 | 8/1992 | Block | 482/124 |
| 5,176,377 | 1/1993 | Wilkinson | 482/114 |
| 5,190,512 | 3/1993 | Curran | 482/124 |
| 5,234,394 | 8/1993 | Wilkinson | 482/121 |
| 5,234,395 | 8/1993 | Miller et al. | 482/118 |

FOREIGN PATENT DOCUMENTS

| | | | |
|---|---|---|---|
| 0020463 | 8/1908 | United Kingdom | 482/124 |

*Primary Examiner*—Richard J. Apley
*Assistant Examiner*—Jerome W. Donnelly
*Attorney, Agent, or Firm*—Small Larkin & Kidde

[57] ABSTRACT

A reciprocating variable isotonic resistance upper extremity and upper torso exercising belt for use while performing predominantly lower extremity and lower torso aerobic exercises.

5 Claims, 4 Drawing Sheets

RECIPROCATING VARIABLE ISOTONIC RESISTANCE UPPER EXTREMITY AND UPPER TORSO EXERCISER

BACKGROUND OF THE INVENTION

1. Field Of The Invention

This invention relates to a reciprocating variable resistance isotonic exercise device for exercising the primary muscles comprising the upper extremities and upper torso, without putting undue stress on the shoulder joint, including an adjustment for accommodating the optimum range of motion associated with persons of varying arm length and including an isotonic resistance mechanism with adjustment for accommodating the optimum exercise resistance associated with persons of varying muscle strength and endurance.

It is well-known in the study of exercise physiology and in the fitness industry that aerobic exercise is optimized when the principal muscles in the upper extremities and upper torso are recruited in exercises that are predominately lower extremities and lower torso intensive.

The principal upper extremity and upper torso muscles include the pectoralis major, pectoralis minor, deltoids, biceps, coracobrachialis, triceps, anterior serratus, and the posteriorserratus, which are more fully described as follows:

1. The pectoralis major muscles are broad flat muscles which extend from the breast bone upward and laterally attaching to the collar bone, acromioclavicular joint of the shoulder and to the humerus bone of the upper arm. The pectoralis major adducts, internally rotates and flexes the upper arm.

2. The pectoralis minor muscles are round muscles, laying under their corresponding pectoralis major muscles and extend upward and laterally from the anterior of the third, fourth and fifth ribs to attach to a small anteriorly protruding bony process of each scapula (the coracoid process). The pectoralis minor adducts and internally rotates the upper arm and assist the inspiration phase of respiration.

3. The deltoid muscle comprises three groups, the anterior, the middle and the posterior deltoids, which arise respectively from the collar bone anteriorly, the acromion of the scapulae in the midline and the posterior spine of the scapulae posteriorly and extend inferiorly as a group to attach to the deltoid tuberosity of the upper arm humerus bone. The deltoids flex, extend and abduct the shoulder joint.

4. The biceps muscles are long round muscles in the anterior of each upper arm which extend from two attachments at the scapulae above and below the shoulder joint and pass downward to cross over the elbow joint and attach to a tuberosity of the radius bone of the forearm. The biceps muscle, therefore, has action over two joints, the shoulder joint and the elbow joint. The biceps flex both the shoulder and elbow joints.

5. The coracobrachialis muscles are short round muscles that take their attachments from the coracoid process of the scapulae anteriorly and pass laterally to attach to the medial mid-line of the humerus bone of the upper arm. The coracobrachialis flexes and medially adducts the upper arm and shoulder.

6. The triceps muscles are long round muscles that attach to the scapulae and humerus bones and extend downwardly to attach to the ulna bone of the forearm. The triceps extend the shoulder and elbow joints.

7. The serratus anterior muscles are a thin sheet of muscle arising from the outer surfaces of the upper eight ribs by a series of fleshy digitations and pass under the scapulae to attach to the medial border of the scapulae. The serratus anterior holds the scapulae against the posterior chest wall providing optimum mechanical postural advantage of the upper spine and shoulder joint.

8. The serratus posterior muscles are a thin sheet of muscle arising from lower cervical and upper thoracic spines and extend downward and laterally to attach to the upper ribs two to five posteriorly. The serratus posterior are important muscles of respiration.

It can be seen from the above explanations that the primary movements required by any effective body exerciser are divided into two primary functional movement patterns, the first being flexion and adduction of the upper arm and flexion of the forearm, and the second being extension and abduction of the upper arm and extension of the forearm.

Various resistance-type exercise devices for exercising the upper body while performing predominately lower body aerobic exercise, such as walking and jogging, are known. However, it has been found that when a person undertakes a program of exercising the upper body muscles by systematic use of such devices, that person often soon abandons the program because the resistance provision is either unadjustably accommodating to the individual user's condition of upper body strength, fails to provide a variable resistance that increasingly challenges the user's upper body muscles as the user increases in strength or provides a form of resistance that is incompatible with the coordination requirements of upper and lower body aerobic exercise, thus rendering the device ineffective or obsolete.

Many of these devices incorporate an elastic member as the resistance means. These devices are substantially ineffective for their intended purpose and may be harmful to the joints of the body since the resistance progressively increases as the elastic member is stretched through the exercise range of motion, thus placing a progressively increasing load on the body joints at the extreme ranges of motion where the joint is at its weakest posture. As well these devices do not provide increasing challenge to the user's muscles once the user has become sufficiently strong enough to overcome the elastic resistance force. Some of these devices restrict the exercise in a limited range of motion, thus delivering a generally ineffective exercise for their intended purpose. Still, a further disadvantage of many of these devices relates to their proper fitting and securing about the user's body. Harsh straps and rigid structures tend to bind with the flesh of the user's body and quickly the devices are discarded due to discomfort. Most of these devices require the manufacturing of various sizes to promote proper fitting, thus increasing the manufacturing costs and therefore decreasing their affordability. Still further, few of these devices are simple to manufacture and therefore are not inexpensive, lightweight and unobtrusive enough to be publicly worn and are not comfortably flexible enough to fit adequately snug so as to prevent abrasion of the user's body during their use.

It is well-known that the preferred method for strengthening muscles, improving muscular endurance and enhancing the aerobic effectiveness of exercise is optimally provided by exercise devices that utilize smooth operating variable isotonic resistance. A smooth operating resistance is compatible with the coordinated movements common to aerobic exercises while a variable isotonic resistance promotes muscular strengthening and endurance by providing an increasing challenge to the muscles as their strength and endurance improve. Thus, to enable a reciprocating variable isotonic resistance exercise device to be used effectively by people having different muscular strength and aerobic endurance, and to enable a user to progress through an exercise regime and to remain challenged as his or her muscular strength and aerobic endurance increases, there is a need for a upper extremity and upper torso exercise device which not only meets the above-stated criteria, but also one in which resistance can be delivered smoothly to promote coordination of movement between the upper and lower body while providing a resistance which can be conveniently increased or decreased according to the specific user's physiological limitations.

2. Description Of The Related Art

Numerous devices for exercising the upper extremities and torso are known. For example, U.S. Pat. Nos. 4,986,537; 4,993,705; 4,961,573; 4,335,872; 4,441,707 and 5,234,395 describe devices in the field of the present invention.

There are three basic forms of resistance utilized in exercise apparatus: isotonic (same tone) exercisers, isometric (same length) exercisers and isokinetic (same speed) exercisers. Isotonic exercisers provide an adjustable non-varying resistance whereby the user's effort must match a set resistance force, such as is common in conventional weight lifting exercises. Isometric exercisers utilize an immovable resistance means with the resistance to joint movement being exactly matched by a counterforce applied either by the user's opposing limb or by an immovable object. Isokinetic exercisers provide a resistance mechanism, usually hydraulic or centripetal, wherein the resistance force is proportionately increased by the speed of the movement of the body part as is common in air resistance and hydraulic resistance exercise machines.

U.S. Pat. No. 4,986,537 (D'Orta) provides an isotonic exerciser for the upper extremities, however, both the direction and range of the upper body exercise motion are extremely limited by this device. The ability of the user to use the device in coordinated exercises such as walking is precluded by the unnatural motion of the exercise, and by the required attachment of the device to the user's upper thighs.

U.S. Pat. No. 4,993,705 (Tolle) incorporates elastic bands to provide resistance force. Because it is desirable to provide a constant resistance (isotonic) to the movement, the use of elastic bands is not desirable. Elastic bands increase the resistance force disproportionately as the elastic band is stretched, thus providing an increasing resistance between mid-joint range of motion and full-joint range of motion, thereby increasing the risk of potential injury to the joint. Also, this resistance means is quickly rendered ineffective as the user's muscles increase in muscular strength and endurance.

U.S. Pat. No. 4,961,573 (Wehrell) describes a device with an elastic tension rope which is wound around a number of pulleys to provide a more uniform loading of the upper body muscles and joints. This device is worn about the user's upper torso and thus the direction of the exercise range of motion is straightforward as in a boxer's punch. This exercise movement does not meet the two primary movements required for an effective upper body exerciser. The direction of exercise motion is inadequate for exercising the normal arm swing motion of aerobic exercise such as walking and jogging. Furthermore, this device is extremely complex and bulky, and thus this device would be relatively expensive to manufacture and would not be sufficiently unobvious to be used by the average consumer while exercising in public.

U.S. Pat. No. 4,335,872 (Elkin) describes a device consisting of a rope passing through a padded flexible tube draped behind and around the neck of a user for use in exercising the upper body during walking exercise. Though this is a simple, lightweight exerciser, it provides no variable resistance, with the rope passing through the flexible tube unobstructed and thereby providing solely isometric-type resistance to the exercise. Isometric resistance is contrary to the smooth reciprocating coordinated movement requirements of aerobic exercise such as walking or jogging.

U.S. Pat. No. 4,441,707 (Bosch) describes a device similar to Elkin's, wherein a rope passes through a tube that encircles behind the user's back. Bosch's device has the same limitations as Elkin's device.

U.S. Pat. No. 5,234,395 (Miller and Colonello) describes an adjustable assymetric-resistance upper body exerciser which includes a generally arcuate belt encircling the waist of a user having a rigid posterior central portion, generally conforming to the shape of the user's back to limit rotation of the device on the body. The belt also has generally flexible anterior portions including a buckle to tighten the belt around the user's waist. A flexible inelastic cord passes through an elongated guide attached to the belt that slidably retains a central portion of the length of the cord, leaving the right and left ends of the cord extending in the anterior direction and terminating in adjustable-lengths in a pair of handles.

A friction snubber is attached to the rigid posterior portion of the belt, in contact with the slidable cord and applying an adjustable friction load to the rope. A user wearing the belt encircling the waist may alternately pull said left and right handles with a tension force generally proportional to the friction load applied to the cord by the snubber. The snubber includes a friction shoe having a resilient support applying a friction load to the cord which is in turn applied by an adjustable knob on a screw passing through the rigid posterior portion of the belt. This permits the user to turn the knob to adjust the friction load on the cord.

However, this design requires the device to be offered in various sizes; the lengths of the belt and elongated guide tube are fixed and do not accommodate to the individual user's waist size. Should the user chose a size which is too large, skin abrasion, due to slippage of the device about the user's waist, would likely result. It is imperative, for the proper functioning of the device, that the lateral margins of the belt and the free ends of the cord be positioned directly over the lateral margins of the user's waist, to thereby prevent chaffing of the user's lateral waist by the cord. Too small a sizing of the device would cause skin abrasion of the lateral waist by the rope. Therefore, the device of the '395 patent must be manufactured in various sizes to promote proper fitting and thereby its optimum function. The free ends of the elongated guide extend anteriorly beyond the flanged portion of the elongated guide and move freely upward and downward as the user flexes and extends his or her arms during use of the device. The repeated stress to the elongated tube by this movement predisposes the free ends of the tube to early fatigue and fracture at their communication with the tangential flanges. Still a further disadvantage of the '395 patent design relates to the rigid posterior central portion of the belt which tends to bind the flesh of the user's back, especially in the obese user. To reduce this discomfort, the user must tightly cinch the belt about the user's waist which may lead to pressure complications secondary to obstruction of blood flow through the skin directly under the rigid posterior central portion. Still a further drawback of this device is the design of the friction applying snubber and the elongated guide means. The snubber design necessitates attachment of the rotating hand knob and the screw biases resilient support to the rigid posterior central portion with the resilient support being subject to early fatigue, thereby substantially reducing the functional life of the snubber mechanism. Another drawback of this device relates to its failure to dissipate the heat produced secondary to the friction forces generated on the cord by the snubber and elongated guide. Consequently, the functional cord life is substantially shortened. Yet a further drawback of this device relates to the expense of manufacturing the device, wherein a layer of friction increasing material must be sewed, glued or otherwise fixed to the inward-facing surface of the belt, the elongated guide tube must be fastened to the belt through its tangential flanges, cylindrical bushings must be attached to opposite ends of the elongated guide to prevent abrasion of the cord by the margins of the elongated guide during use and the rigid posterior central portion must be fastened to the flexible anterior portions of the belt. This manufacturing process is labor intensive and subjects the device to multiple potentials for failure of the product to function for its intended purpose.

OBJECT AND SUMMARY OF THE INVENTION

Accordingly, it is an object of the present invention to provide an improved, simple to manufacture, affordable and lightweight reciprocating variable isotonic resistance exercise device for exercising the upper extremities and upper torso, without overstressing the joints thereof, while performing predominately lower extremity and lower torso aerobic exercises.

In general terms, the device includes: a plurality of removable channeled housings to allow for the accurate sizing (one size fits all) of the device to the user's individual waist measurement, the housings being slidingly mounted on a flexible belt having, anteriorly, a means for buckling; a resistance housing including a means to provide a resistance force; a flexible inelastic rope having a length and two ends passing through heat dissipating guide tubes mounted in the resistance housing and including a handle fixed to each of the two ends of the rope with at least one of the handles including a means for variably positioning the handle along the length of the rope and thereby varying the stroke of the exercise to optimize the exercise range of motion and a smooth acting, heat dissipating, modified guide tube forming a variable, pincer-type, isotonic resistance force generator.

In more detail, the preferred embodiment of the present invention comprises: a plurality of flexible rubber-like removable housings having within their interior a channel and a bore with one of the housings retaining a means to provide a resistance force; the housing channels are sized and shaped to slidingly retain the width and thickness of a belt thereby permitting the removal of a desired number of housings (excluding the resistance housing retaining the resistance means) to provide a one-size-fits-all device by the selective sliding and positioning of the lateral housings over the lateral margins of the user's waist; the housing bores are sized and shaped for mounting a plurality of guide tubes for promoting escape, through conduction and radiation, of heat produced secondary to the use of the device; a flexible inelastic rope passes through each of the guide tubes of each housing leaving the right and left free ends of the rope extending unobstructed in the anterior direction; a pair of handles attached to the right and left free ends of the rope with at least one of the handles having an adjustable means for varying the length of the rope and thereby to provide adjustment to the exercise range of motion specific to the individual user's arm lengths; a resistance means fitted within the bore of one of the belt mounted housings comprises a guide tube notched at its left and right ends and having a threaded orifice in its outward-facing wall engaging a threaded thumb screw contacting in the interior of the guide tube with a outward-facing surface of a metal U-shaped shoe having outward facing flanges at both its left and right ends and mounted within the lumen of the notched guide tube the left flange interlocking with the left notch to thereby resist the lateral displacement of the U-shaped shoe as the rope is progressively pinched, by the manual turning of the thumb screw, between the inward-facing surface of the U-shaped shoe and the interior wall of the guide tube as the rope is slidingly moved back and forth by the reciprocal pulling of the right and left handles by the user.

BRIEF DESCRIPTION OF THE DRAWING(S)

DESCRIPTION OF THE PREFERRED EMBODIMENT

Figure 1:
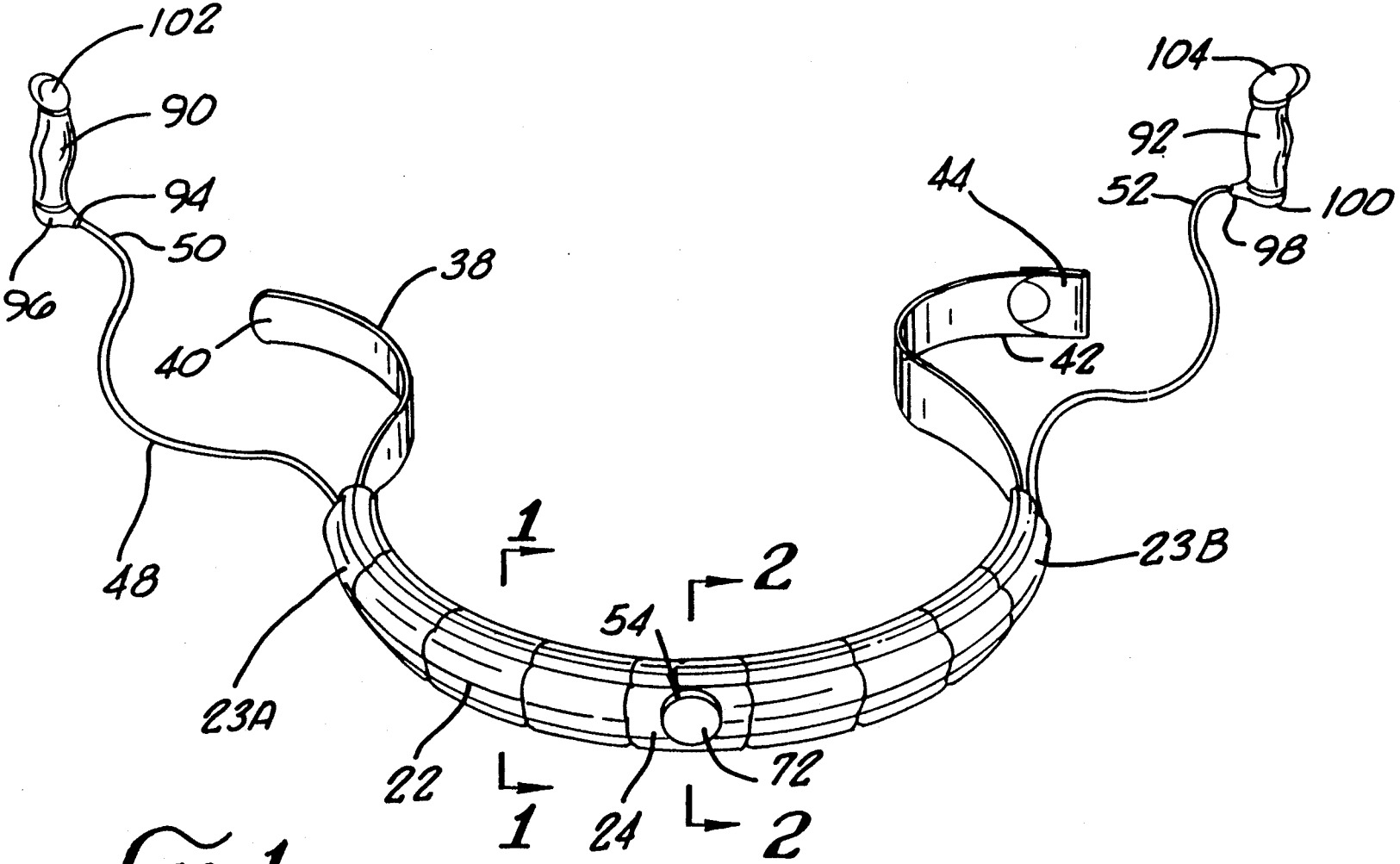
FIG. 1 is a perspective view of a reciprocating variable resistance upper body exerciser according to the present invention.
Figure 2:
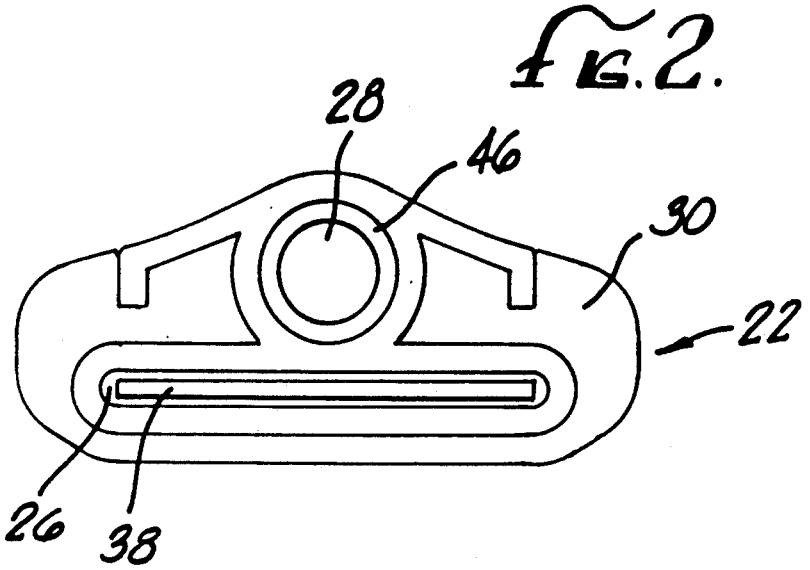
FIG. 2 is a cross-sectional end view of one of the removable housings of the exerciser of FIG. 1, taken in a vertical plane along section line 1—1 of FIG. 1.

In FIGS. 1–2 a reciprocating variable resistance isotonic upper extremity and upper torso exerciser 20 according to the present invention is shown having a flexible belt 38 for encircling the waist of a user, including a buckle 44, slidingly mounted within a plurality of sized and shaped channels 26 formed within the interiors 30 of a plurality of removable, flexible rubber-like housings 22 and 23; and in a sized and shaped channel within the interior 36 of housing 24 to thereby provide comfort, reduce slippage of the device about the user's waist during use, and provide for the universal sizing of the device 20 specific to the individual user's waist size by the simple removal of one or more of the housings 22 or 23 from the belt 38. A flexible inelastic rope 48, having a length and a left and right end 50 and 52, respectively, passes through a plurality of guide tubes 46 mounted in bores 28 formed within the interiors 30 of the housings 22 and 23 and through a notched guide tube 56 mounted in a bore 34 within the interior 36 of housing 24. Rope 48 extends from the end of the end housings 23A, 23B of the device 20 in the anterior direction ending freely in left and right ends 50 and 52, respectively. Guide tubes 46 and 56 are formed preferably of a heat conducting metal or other heat conducting rigid material to thereby protect housings 22, 23 and 24 from abrasion by rope 48 and to dissipate the heat generated by the friction of the reciprocating passage of the rope 48 through tubes 46 and 56.

Figure 3:
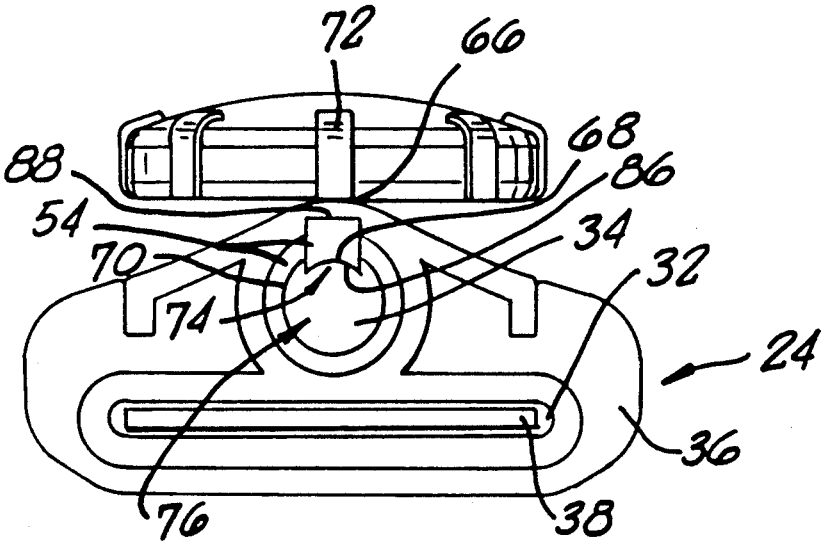
FIG. 3 is a cross-sectional end view of the resistance housing of the exerciser of FIG. 1, taken along section line 2—2 of FIG. 1.

In FIGS. 2-3, it may be seen that the belt 38 is slidingly disposed in channels 26 of housings 22 and 23 and in channel 32 of housing 24. Rope 48 may be slidingly disposed in guide tubes 46 mounted in bores 28 of housings 22 and 23 and in guide tube 56 mounted in bore 34 of housing 24, although for purposes of clarity this is not shown in FIGS. 2-3. The user may selectively remove a desired number of housings 22 and 23 by sliding one or more housings 22 or 23 off of belt 38 to size the device 20 to the user's waist and thereby ensure a proper fit, thus negating the need for the manufacturing of the device 20 in multiple sizes.

Figure 4:
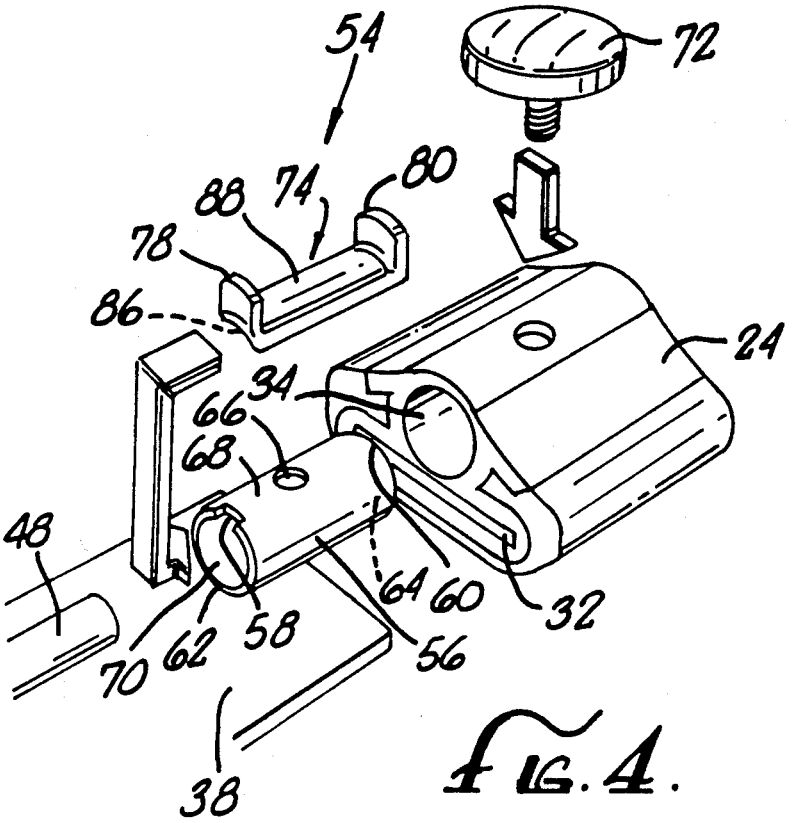
FIG. 4 is an exploded perspective view of the resistance housing of the exerciser of FIG. 1.

As shown in FIG. 4, a variable isotonic resistance means 54 is formed from guide tube 56, having left notch 58 at its left end 62. Guide tube 56, mounted in bore 34 of resistance housing 24, includes a threaded orifice 66 on its outward-facing wall 68 which engages a manually rotatable thumb screw 72. The clockwise rotation of screw 72 into orifice 66 causes screw 72 to enter a lumen 76 of the tube 56 and make contact with a outward-facing surface 88 of a U-shaped metal shoe 74 which is docked within lumen 76 of tube 56 to thereby compress shoe 74 against the rope 48 and apply a resistance to the reciprocating passage of rope 48, set and varied by the manual turning of the screw 72. Shoe 74 includes a pair of outward-facing flanges 78 and 80 at its left and right ends 82 and 84, respectively. Left flange 78 interlocks with left notch 62 of the guide tube 56 to thereby resist the rotational dislodgment of shoe 74 by the back and forth movement of rope 48 during use of the device 20. Resistance means 54, including guide tube 56, shoe 74 and screw 72 supplies resistance to the passage of rope 48 by the pinching of rope 48 between a inner wall 70 of guide tube 56 and a inward-facing surface 86 of shoe 74. Guide tubes 46, guide tube 56 and shoe 74 are preferably formed of a heat conducting metal and have a substantially larger diameter than rope 48 to dissipate the heat produced by the friction of the sliding rope 48 through tubes 46 and resistance means 54 to thereby reduce wear on rope 48 during use of the device 20. Left and right handles, 90 and 92, respectively, are adjustably attached to the left and right free ends 50 and 52 of rope 48 whereby a user may self-adjust the functional length of rope 48 to accommodate his or her arm lengths and alternately pull left and right handles 90 and 92 through a full range of upper extremity exercise motion.

Figure 5:
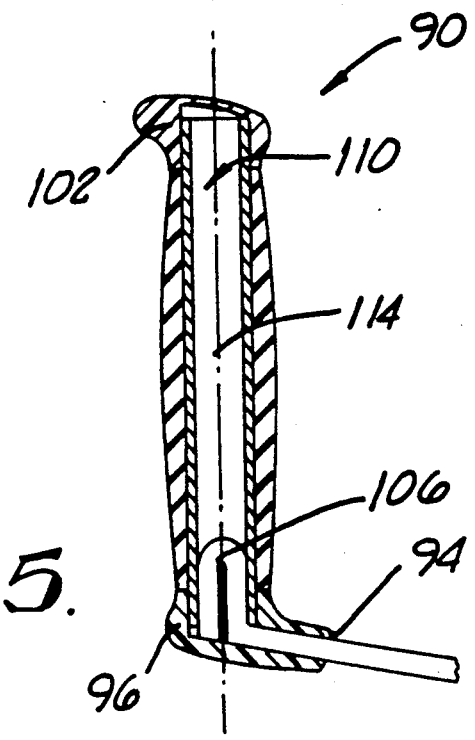
FIG. 5 is a transverse cross-sectional view of the handles of the exerciser of FIG. 1, taken along section line 3—3 of FIG. 1.

In FIGS. 1 and 5, a pair of handles 90 and 92 is shown in which the free ends 50 and 52 of rope 48 are passed through openings 94 and 98 provided in a bottom surface 96 and 100 of the left and right handles 90 and 92, respectively, to prevent abrasion of the user's wrist and forearms by the rope 48 during use. Handles 90 and 92 include removable top caps 102 and 104 to allow the user access to the respective free ends 50 and 52 of rope 48 whereby the removal of one top cap 102 or 104 permits the user to grasp rope 48 and pull rope 48 up through either of the top openings 110 or 112 of the left or right handles 90 and 92, respectively, and selectively adjust the placement of a knot 106 or 108 along the length of rope 48 within lumen 114 or 116 of handles 90 or 92, thereby preventing escape of rope ends 50 and 52 from openings 94 and 98 of handles 90 and 92, respectively, to permit the user to adjust the functional length of rope 48 to a length appropriate to the user's arm lengths whereby a full range of motion exercise is achieved. Also, the feature permits removal and/or addition of housing units 22 and 23, as described above.

Figure 6:
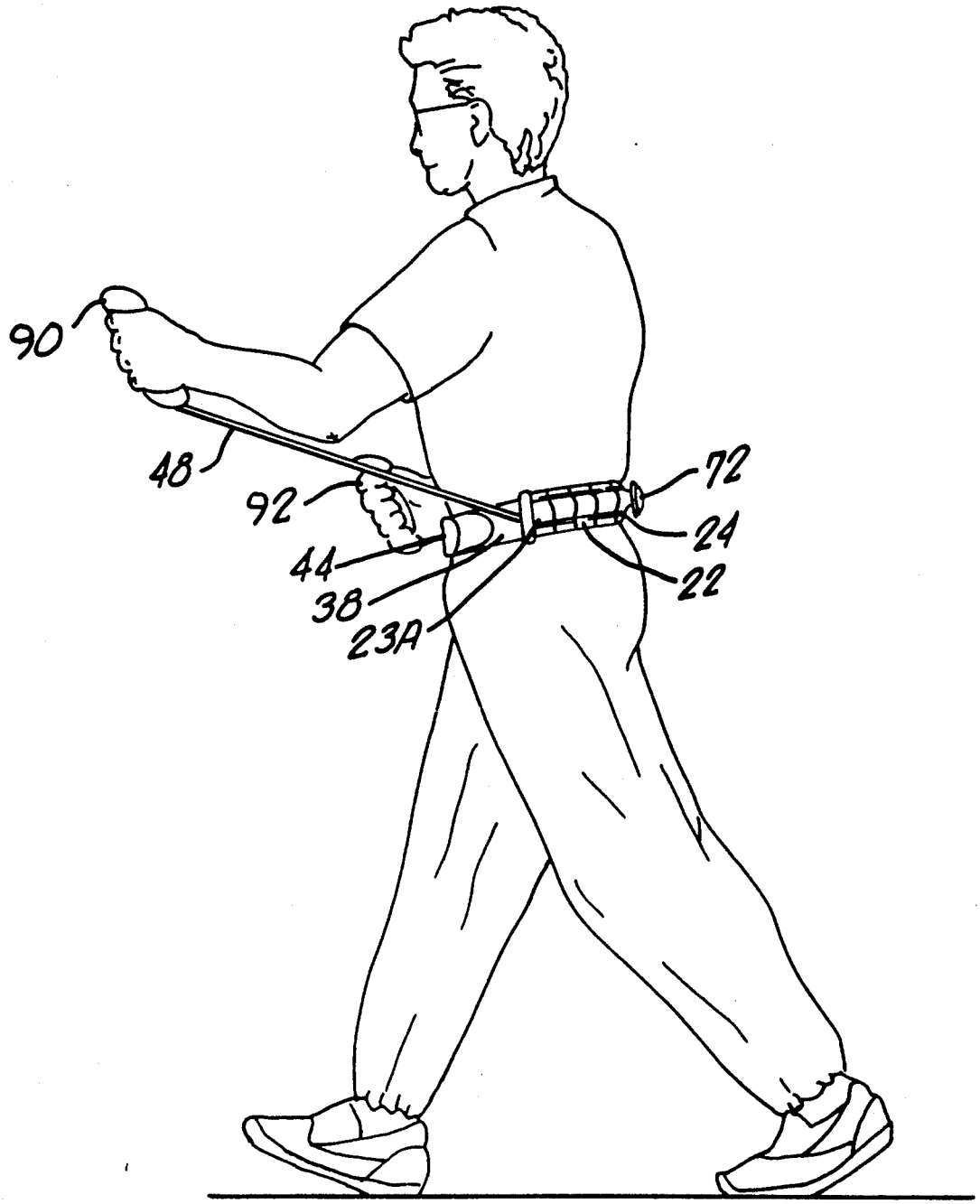
FIG. 6 is a side elevational view of the exerciser of FIG. 1, shown during use by a user.

In FIG. 6, a user is shown using the device 20 wherein the user having determined the appropriate number of housings 22 and 23 of the device 20 required to size the belt 38 to the user's waist and positioning the lateral housings 23A and 23B over the lateral margins of the user's waist and positioning resistance housing 24 in the center at the small of the user's back and securing the device 20 by closing the buckle 44. The user grasps handles 90 and 92 in each respective hand and reciprocally pulls the rope 48 back and forth through the plurality of housings 22, 23 and 24 against the resistance which is selectively set to a level appropriate for the user's muscular strength and endurance by the turning of screw 72 to facilitate the aerobic benefits of the otherwise predominantly lower body aerobic exercise, such as walking, running, stepping or jogging, while simultaneously strengthening and conditioning the primary muscles of the upper extremities and upper torso.

I claim:

1. A reciprocating variable isotonic resistance upper extremity and upper torso exerciser comprising:

a plurality of removable and flexible housings having a channel and a bore interiorly said housing being slidingly mounted on a waist encircling belt; a means for buckling said belt;

a flexible inelastic rope having a length and right and left ends;

a plurality of guide tubes mounted in said bores of said housings, said members slidably retaining said rope, leaving said right and left ends extending therefrom in the anterior direction;

a resistance means being mounted in one of said bores of one of said housing, which contacts and slidable rope to impart a resistance thereon, further including: notched guide means having a threaded orifice in a outward facing wall thereof, a threaded thumb screw engaging therein, a U-shaped metal shoe having flanges at its left and right ends whereby said shoe is docked in a lumen of said notched guide with one of said flanges interlocking with one of said notches of said guide means to retain said shoe in place during use, whereby a turning of said crew adjust the friction load bom on said rope; and handles attached to a left and a right end of said rope, whereby, during use, a user may reciprocally pull said left and right handles against a resistance provided by said means for providing a resistance.

2. An exerciser according to claim 1 in which said guide tubes and means for providing a resistance are preferably formed of heat conducting metal.

3. An exerciser according to claim 1 in which said handles comprise elongated tubes, each said tube having a closed lower end, having a hole therein and an open upper end, through which said rope is pulled, passing through said holes in said lower end of said handles.

4. An exerciser according to claim 1 in which each of said housings is formed of a flexible elastomeric material, has a channel of predetermined size and shape, and has a bore of predetermined size and shape within its interior.

5. An exerciser according to claim 1 wherein said guide tubes are chamfered to prevent chaffing of the rope during use.

* * * * *